United States Patent [19]

Helber, Jr. et al.

[11] Patent Number: 4,616,596

[45] Date of Patent: Oct. 14, 1986

[54] ELECTROLESS PLATING APPARATUS

[75] Inventors: Carlyle L. Helber, Jr., Fountain Valley; Frank A. Ludwig, Rancho Palos Verdes, both of Calif.

[73] Assignee: Hughes Aircraft Company, Los Angeles, Calif.

[21] Appl. No.: 789,867

[22] Filed: Oct. 21, 1985

[51] Int. Cl.[4] ..... B05C 11/10; B05C 3/05

[52] U.S. Cl. ..... 118/603; 118/429; 118/612

[58] Field of Search ..... 118/425, 429, 602, 603, 118/612; 427/443.1, 437, 438

[56] References Cited

U.S. PATENT DOCUMENTS 4,152,467 5/1979 Alpaugh et al. ..... 427/443.1 X 4,262,044 4/1981 Kuczma, Jr. ..... 427/443.1 X 4,550,036 10/1985 Ludwig et al. ..... 118/400 X

*Primary Examiner*—John P. McIntosh

*Attorney, Agent, or Firm*—M. E. Lachman; A. W. Karambelas

[57] ABSTRACT

An apparatus for use in electroless plating wherein the activity of the plating solution is controlled by regulating the oxygen content of the plating solution. The apparatus includes an outer container in which the stabilized, oxygen-rich plating solution is stored. An oxygen sparger is located in the outer container to introduce a predetermined amount of oxygen into the plating solution to stabilize it. A flux container and plating vessel are located inside the outer container and define a separate flux zone and a separate plating zone, respectively, through which the plating solution is passed. A nitrogen sparger is located within the flux container to purge all or some oxygen from the stabilized plating solution to provide an active plating solution. The active plating solution is passed from the flux container into the plating vessel where plating of the substrate takes place. Active plating solution continually flows from the plating vessel back to the oxygen-rich reservoir for oxygenation and storage prior to recycling back through the flux container and plating vessel.

11 Claims, 4 Drawing Figures

ELECTROLESS PLATING APPARATUS

BACKGROUND OF THE INVENTION

1. Field of the Invention

The present invention relates generally to electroless plating apparatus for use in processes based upon the autocatalytic plating of various metals such as silver, gold, platinum, nickel, copper, and palladium onto various substrates. More particularly, the present invention relates to an apparatus for use in a process where the amount of oxygen in the electroless plating solution or bath is controlled to provide stable electroless solutions and in which the rate of autocatalytic metal deposition and the characteristics of the resulting metal plating are controlled in part by the oxygen content of the electroless plating solution.

2. Description of the Related Art

Electroless plating is based upon the autocatalytic or spontaneous decomposition of a metal compound in a plating solution to provide deposition and plating of the metal onto a particular substrate which is immersed in the solution. Electroless nickel plating processes and electroless copper plating processes are well known and commercially widely used. Processes for electroless plating of gold, platinum, palladium and silver are also well known.

Electroless silver plating has particular application to the plating of passive microwave components. Passive microwave components are fabricated by machining, casting, dip brazing, electroforming or resin composite methods. The materials used are aluminum, invar (a nickel-iron alloy), and other metal and resin composites. Generally these components are silver electroplated to improve the Quality Factor (Q Factor) of the device, which is a measure of how well the device performs as a microwave cavity.

The electrical performance or Q Factor of passive microwave components is directly related to the geometry of the component, surface smoothness, silver purity, silver deposit density (voids and lattice misfit), and the specific conductance of its energy propagating surfaces. To provide desired electrical performance, the surfaces are typically silver electroplated to a thickness of between 100 to 1000 microinches (2.54 to 25.4 micrometers) depending on the energy frequency design of the component. Unfortunately, conventional electroplating does not deposit silver uniformly onto all the component surfaces. External surfaces rapidly build up a silver layer while internal, recessed surfaces are barely covered. The result can be a detrimental change of critical dimensions in high current density areas and insufficient silver deposit or plating at recessed surfaces. Although the insufficient and irregular silver thickness resulting from electroplating causes the Q Factor to be less than desired, the silver deposit conductance is still quite good and in spite of these difficulties generally provides a better overall Q Factor for the component than if no silver plating is provided.

The problems with non-uniform silver deposit thickness on complex structures resulting from electroplating can be overcome if the deposit is made by electroless or autocatalytic silver deposition. Electroless or autocatalytic silver plating is capable of depositing a silver layer uniformly over any geometry and is especially well suited for plating passive microwave components.

Although electroless silver technology is well established, silver electroless plating has not become a commercial technology because the plating baths tend to spontaneously decompose forming silver type particles throughout the solution. This decomposition causes loosely adherent, very fine silver metal particles to be deposited roughly on the plating surface at some unknown time during plating. The result is an unacceptable microwave silver deposit. This plating bath instability tendency can be decreased, but not eliminated, by adjustment of the solution concentrations. However, these adjustments lower the silver deposition rate to 0–3 micrometers/hour compared to about 10 micrometers/hour for commercial electroless nickel.

Various different plating surface textures are desirable depending upon the particular application for which the plated surface is to be used. For example, a smooth plating deposit is usually desirable in certain critical applications such as microwave waveguide components to decrease signal losses, or in optical devices and bearings to improve performance. In other situations, it is desirable to provide a plating surface which is rough to dendritic to allow adhesion of various plastics or other materials to the plated surface.

Allowed patent application, Ser. No. 662,110, filed on Oct. 18, 1984 and assigned to the present assignee, discloses a process and system wherein the stability of the autocatalytic plating bath is variably controlled to allow desired metal deposition rates during electroless plating while maintaining the stability of the plating solution when the solution is not in contact with the substrate to be plated. The process also provides a convenient and useful means for varying and controlling the characteristics and texture of the plated surface to produce a wide variety of plating surface textures ranging from smooth to rough. The contents of patent application Ser. No. 662,110, filed Oct. 18, 1984, now U.S. Pat. No. 4,550,036 are hereby incorporated by reference.

The above mentioned process was based on the discovery that the stability of the autocatalytic plating solution, the rate of electroless plating and the characteristics of the resulting metal plating layer could be controlled by varying the oxygen content of the plating solution. The latter process is a cyclic process which basically involves continually removing the active plating solution, which is autocatalytic, unstable and capable of electroless plating at a relatively high rate, from the plating zone or bath and exposing the solution to an oxygen-containing gas to increase the oxygen content of the bath to a predetermined level. The resulting high oxygen content plating solution is stable and does not decompose. This stable solution is not only stable, but also passive, i.e., the rate of plating is very low. The passive and stabilized plating solution is then passed through a scrubber, prior to recycling back to the plating zone or bath, to remove a predetermined amount of oxygen from the stablized solution to provide the desired activity or plating rate as it flows through the plating zone.

When the plating bath parameters such as the residence time of solution in the plating zone, solution temperature, and solution composition are kept constant, the above process provides a convenient means to vary and control the activity (i.e., the plating rate) of the plating solution by controlling the oxygen content of the bath. Decomposition of the bath is also reduced because saturation of the plating solution with oxygen when it is not in the plating zone stabilizes the bath and increases its useful life. An additional feature of the process is that the character of the metal electroless plating can be controlled by varying the oxygen content of the solution. When all other plating parameters are the same, a partially deoxygenated plating solution provides a relatively smooth plating finish whereas a relatively rough plating finish is produced by plating with a plating solution that is substantially completely deoxygenated or a solution which is high in oxygen content.

SUMMARY OF THE INVENTION

In accordance with the present invention, an apparatus is provided for carrying out the autocatalytic plating process described above. The apparatus is well suited for variable control of the oxygen content of the plating solution to provide desired metal deposition rates during electroless plating while maintaining the stability of the plating solution when the solution is not in contact with the substrate to be plated.

The present invention is based upon an apparatus which includes an outer container having a top, a bottom, and side walls which define an oxygen-rich solution reservoir. Oxygen sparger means is provided for introducing an oxygen-containing gas into the oxygen-rich solution reservoir to saturate the electroless plating solution in the reservoir with oxygen to produce a stabilized plating solution. A flux container is located inside the outer container. The flux container includes a top, a bottom, and side walls which define a flux zone which is separate from the oxygen-rich solution reservoir. A means is provided for transferring the passive plating solution from the oxygen-rich solution reservoir to the flux zone. Nitrogen sparger means associated with the flux zone is provided for introducing a nitrogen-containing gas into the flux zone to purge oxygen from the stabilized plating solution to produce an active electroless plating solution. In addition to the flux container, a plating vessel is located inside the outer container. The plating vessel includes a top, a bottom, and side walls which define a plating zone which is also separate from the oxygen-rich solution reservoir. A means is provided for transferring the active electroless plating solution from the flux zone to the plating zone for the plating of metal onto the plating surfaces or substrates which are present within the plating zone. To complete the electroless plating cycle, means for transferring the active electroless plating solution from the plating zone back to the oxygen-rich solution reservoir is provided.

As a particular feature of the present invention, the flux container includes a first weir over which the electroless plating solution flows out of the flux container and into the plating zone. As another feature, the plating vessel includes a second weir over which electroless plating solution may flow out of the plating vessel and into the oxygen-rich solution reservoir. The apparatus in accordance with the present invention is designed to provide a compact plating device in which the necessary oxygen content control required to carry out the control of the electroplating process is provided in a single cell container apparatus.

The above-discussed and many other features and attendant advantages of the present invention will become apparent as the invention becomes better understood by reference to the following detailed description when considered in conjunction with the accompanying drawings.

DETAILED DESCRIPTION OF THE INVENTION

Figure 1:
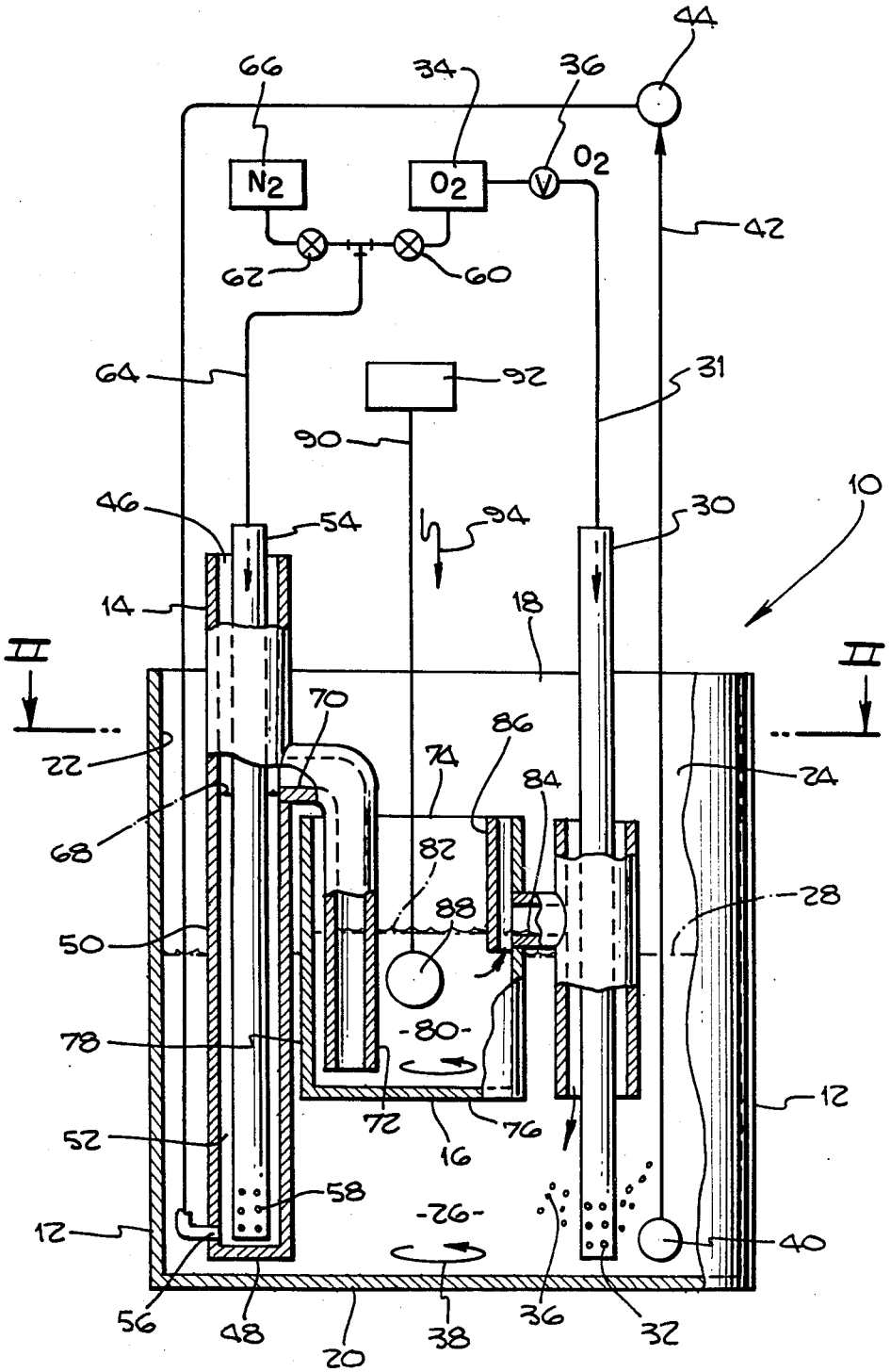
FIG. 1 is a sectional side view of an exemplary electroless plating apparatus in accordance with the present invention.
Figure 2:
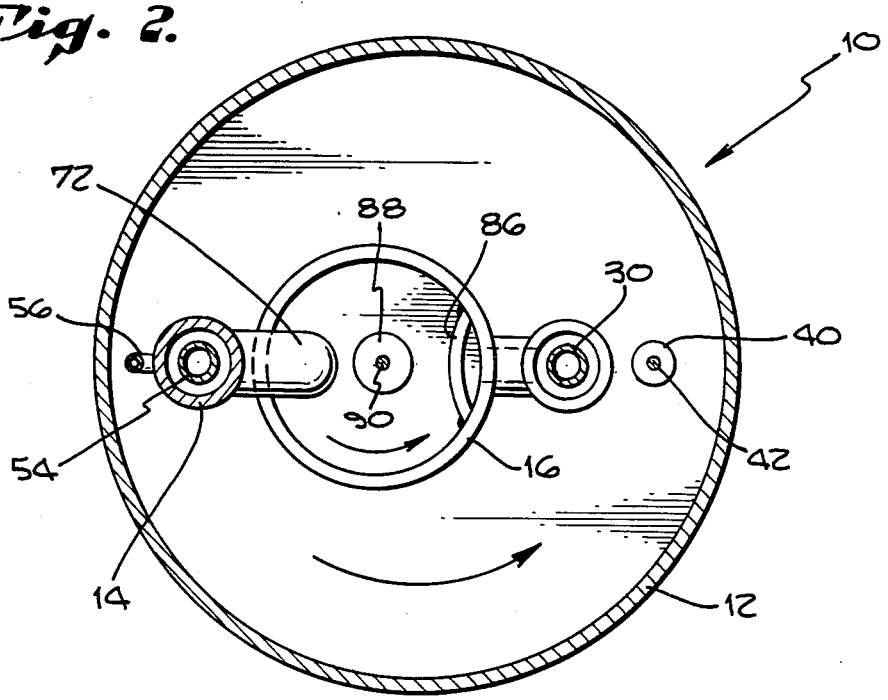
FIG. 2 is a sectional view of FIG. 1 taken in the II—II plane.

A preferred exemplary apparatus in accordance with the present invention is shown generally at 10 in FIGS. 1 and 2. The apparatus 10 is a design for the electroless or autocatalytic plating of metals such as copper, gold, silver, nickel, platinum, palladium and rhodium. The apparatus is especially well suited for use in the electroless plating of silver in accordance with the process set forth in the previously mentioned allowed patent application Ser. No. 662,110.

Although numerous different electroless silver plating solutions may be used in the apparatus 10, the preferred electroless silver solution is an aqueous solution containing silver cyanide, sodium cyanide, sodium hydroxide and dimethylamine borane (DMAB).

The apparatus 10 basically includes an outer container 12, a flux container 14 and a plating vessel 16. The outer container 12 includes an open top 18, a bottom 20 and cylindrical side wall 22, which define a reservoir 24 in which oxygen-rich plating solution 26 is contained. The surface of the oxygen-rich solution is shown at 28.

Oxygen sparger means for introducing an oxygen-containing gas into the oxygen-rich solution reservoir 24 is provided by the oxygen sparger tube 30. The oxygen sparger tube may be any suitable tube having openings 32 through which an oxygen-containing gas may be introduced into the plating solution 26. Oxygen is introduced into the sparger tube 30 from an oxygen reservoir such as oxygen bottle 34. Valve 36 is provided for controlling the flow of oxygen into the sparger tube 30 through line 31. The oxygen-containing gas may be air or pure oxygen.

The amount of air or pure oxygen introduced through valve 36 into the oxygen sparger tube 30 is regulated so that sufficient oxygen bubbles 36 are introduced into solution 26 to insure that the solution contains a sufficient level of oxygen to produce a stablized plating solution as discussed in patent application Ser. No. 662,110. This is typically done by regulating the oxygen flow through oxygen sparger tube 30 to provide the introduction of a controlled amount of oxygen into solution 26. This oxygen-enriched solution is a stabilized or passive solution which does not autocatalytically decompose and remains stable over long periods of time. The oxygen content of the solution 26 may be measured using a commerically available dissolved oxygen meter (not shown), such as that available from Yellow Springs Instruments of Ohio.

A stirring device as represented by arrow 38 is preferably provided for maintaining a homogeneous plating mixture with uniform oxygen distribution. This stirring reduces any possiblity of localized oxygen insufficiency in the solution 26 and the resultant localized autocatalyic decomposition.

The stabilized plating solution 26 is transferred from the solution reservoir 24 into the flux container 14 by pump 44, which pumps solution 26 through filter 40 and transfer line 42 and then through transfer line 43 to inlet 56 into the flux zone 52. The filter 40 may include any conventional filter element having pore sizes sufficiently small to remove free floating catalytic nuclei, such as colloidal silver, minute loosely adherent activation treatment residuals and base metal particles from the solution. Preferably, the filter will remove any particles having a particle size greater than one micron. Removal of the particles from the system prior to introduction into the flux container 14 is important, since these particles act as catalytic nuclei which can ultimately cause decomposition and unacceptable silver deposits while the solution is in the flux container 14 and plating vessel 16. As mentioned in patent application Ser. No. 662,110, the trapped particles in the filter 40 do not cause continued silver deposition and do not grow in size because the oxygenated stabilized solution 26 passing through the filter 40 tends to re-dissolve the silver particles to their original ionic state. This not only increases the useful life of the plating solution, but also reduces the depletion of silver in the plating system due to the formation of collodial silver and base metal particles.

The flux container 14 includes an open top 46, a bottom 48, and cylindrical side wall 50, which define a flux zone 52. A sparger tube 54 is provided to introduce a nitrogen-containing gas into the flux zone 52 to purge oxygen from the stabilized plating solution which is continually introduced into the flux zone at inlet 56. The sparger tube 54 includes holes 58 through which the nitrogen-containing gas is bubbled into the flux zone 52.

Valves 60 and 62 are provided for regulating the relative amounts of nitrogen and oxygen being introduced through line 64 into the sparger tube. Preferably the source of nitrogen is a nitrogen tank containing substantially pure nitrogen as shown at 66. The amounts of nitrogen and oxygen introduced into the flux zone 52 may be regulated to provide the desired level of electroless plating in plating vessel 16. If desired, valve 60 may be closed so that only the nitrogen-containing gas is introduced into sparger tube 54. Thus, the degree of purging of oxygen from the solution 68 in the sparger tube 54 is regulated by the amount of nitrogen bubbled into the solution through holes 58. Alternatively, valve 60 may be partly opened so that a desired nitrogen/oxygen ratio may be selected for introduction into the flux zone 52. The solution 68 is saturated with the nitrogen-/oxygen gas mixture to thereby provide the desired degree of purging of oxygen from the stablized solution as it enters the flux zone 52 through inlet 56.

The flux container 14 includes a first weir 70 over which the oxygen-poor activated plating solution continually flows. The activated solution flows over weir 70 and downward through conduit 72 into the plating vessel 16. The plating vessel 16 is constructed so that it may be flooded with nitrogen gas above the solution level 82 therein by passing nitrogen gas through the top 74 which impedes mixing of external air with nitrogen in vessel 16. The plating vessel 16 also includes a bottom 76, and cylindrical side wall 78, which define a plating zone 80 which is separate from the oxygen-rich solution reservoir 24. The active solution 82 present in the reservoir 80 continually flows out of the reservoir 80 over a second weir 84. The solution flows over weir 84 and into the oxygen-rich solution 26 where it is passivated. A downward weir 86 is provided to prevent possible contamination of the plating solution 82 by the oxygen-containing gas being introduced into the oxygen-rich solution reservoir 24.

The substrate 88 to be plated may be any of the known materials upon which silver is autocatalytically plated. Preferably, the substrate 88 is attached to a suspension device, as represented schematically at 90, which is vibrated up and down by a vibrator shown schematically at 92. Preferably the direction of vibration will be up and down as represented by arrow 94. The agitation of the substrate 88 helps release gas bubbles that may be adhere to the plating surface.

It is preferred that the entire plating apparatus be temperature controlled. Preferably a heating mantle or other device (not shown) is placed around the outer container 12 to provide relatively uniform heating of the entire apparatus. The heating mantle should be of sufficient capacity to maintain a temperature of between about 20° C. to 80° C.

As previously mentioned, during operation of the unit, the valve 60 may be closed entirely or partially open to provide the desired degree of oxygen purging in the flux container 14. When it is desired to shut the system down, valve 62 is closed and valve 60 opened. This allows only oxygen to be bubbled through the plating solution 68 in the flux container 14 in order to passivate it. Additionally, valve 36 is left open. Pump 44 is then operated with oxygen-containing gas bubbling through both sparger tubes 30 and 54 until the plating solution throughout the entire apparatus is oxygenated and passivated.

Figure 4:
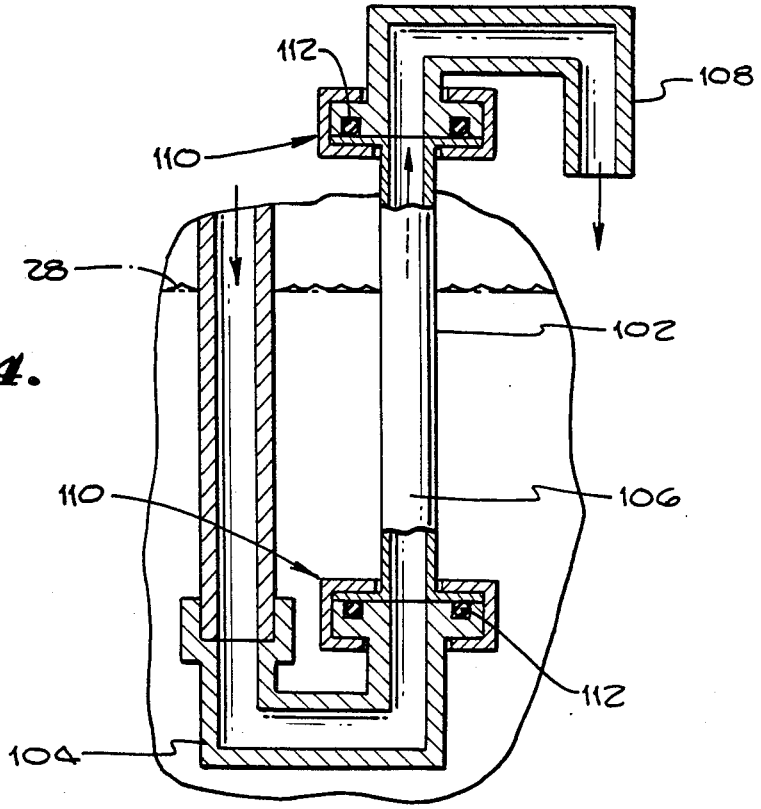
FIG. 4 is a more detailed view of the central portion of FIG. 3.
Figure 3:
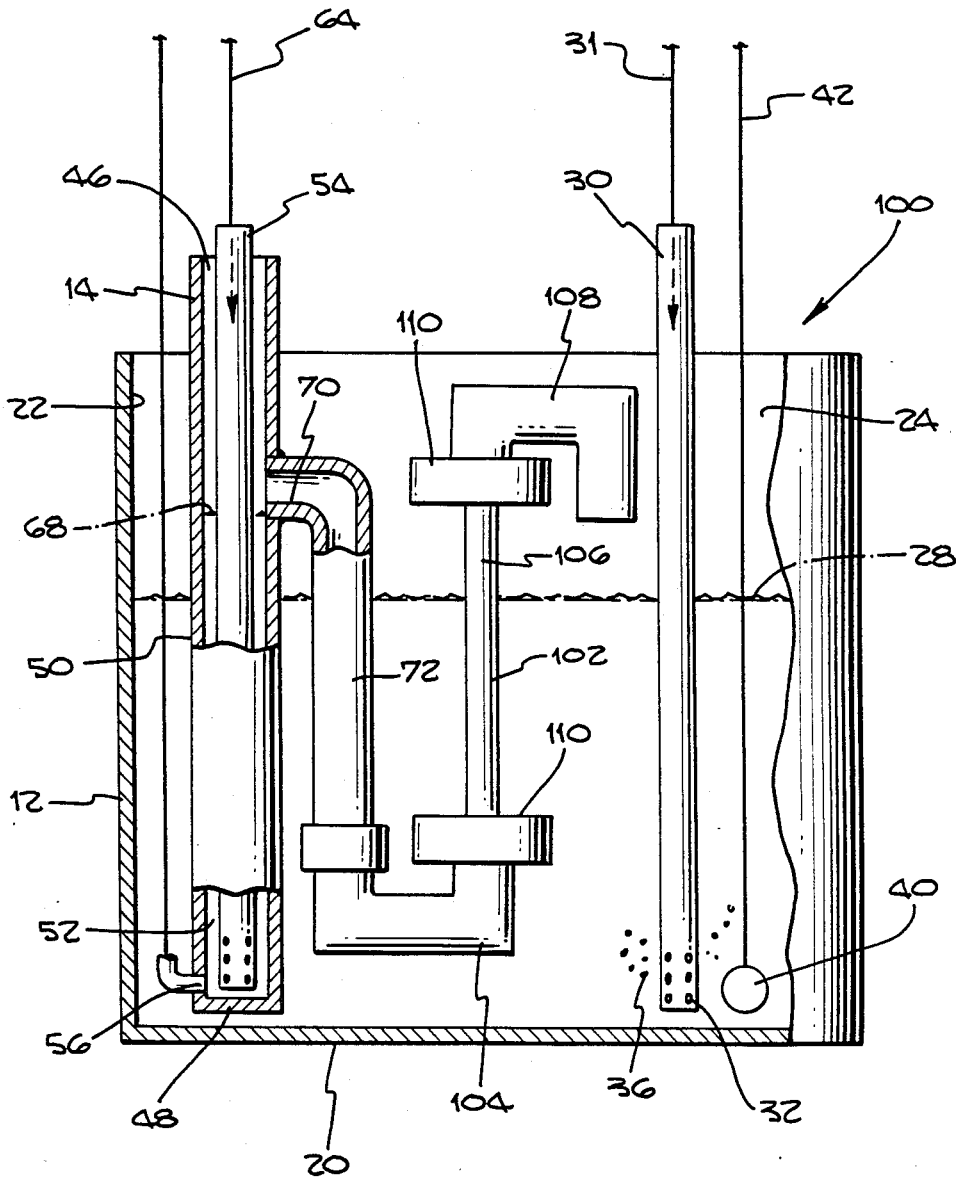
FIG. 3 is a partial side sectional view of an alternate exemplary embodiment showing the apparatus adapted for the electroless plating of a microwave waveguide.

An alternate embodiment of the present invention is shown generally at 100 in FIG. 3 and shown in more detail in FIG. 4. The apparatus shown in FIG. 3 is the same as the preferred embodiment shown in FIGS. 1 and 2 except that the substrate to be plated is the interior surface of a channel-like structure, such as a microwave waveguide 102. In this configuration, the deposition chamber 16 in FIGS. 1 and 2 is replaced by an adapter 104 which directs the activated solution through the internal channel 106 of the waveguide 102. An overflow adapter 108 directs solution emerging from the waveguide 102 back into the oxygen-rich reservoir 24. Clamps 110 and O-rings 112 or similar gasket connections are used to connect the waveguide 102 to the adapters 104 and 108 to prevent leakage. Agitation of the solution in waveguide 102 is supplied by virtue of the solution flow. The top of the nitrogen flux container 14 is higher than the top of the overflow adapter 108 to provide complete flow-through of solution. It should be noted that different adapters may be required for different workpieces and that the configuration shown in FIG. 3 is exemplary only for the particular waveguide design depicted. Also, the volume of the adapter should be kept small relative to the flow rates so that solution decomposition does not occur.

Having thus described exemplary embodiments of the present invention, it should be noted by those skilled in the art that the disclosures within are exemplary only and that various other alternatives, adaptations and modifications may be made within the scope of the present invention. For example, the present invention is not limited to use for forming silver plating on a substrate, but may be used for the electroless or autocatalytic plating of any metal from a solution which is stabilized and activated by alternate gas purging as de-scribed herein using oxygen and nitrogen gases as examples. Accordingly, the present invention is not limited to the specific embodiment as illustrated herein, but is only limited by the following claims.

What is claimed is:

1. An apparatus adapted for use in electroless plating wherein a metal is autocatalytically plated from an electroless plating solution onto a plating surface by a process in which the activity of the plating solution is regulated by the amount of a first predetermined gas dissolved in the plating solution, which comprises:

(a) an outer container having a top, a bottom, and side walls defining a reservoir for plating solution rich in said first predetermined gas;

(b) first sparger means for introducing said first gas into said reservoir in a sufficient amount to provide a predetermined level of said first gas in the electroless plating solution in said reservoir, to produce a stabilized plating solution;

(c) a flux container located inside said outer container, said flux container having a top, a bottom, and side walls defining a flux zone which is separate from said reservoir;

(d) means for transferring stabilized plating solution from said reservoir to said flux zone;

(e) second sparger means associated with said flux zone for introducing a second predetermined gas into said flux zone to reduce the amount of said first gas in said stabilized plating solution to a level sufficient to produce active electroless plating solution;

(f) a plating vessel located inside said outer container, said plating vessel having a top, a bottom, and side walls defining a plating zone which is separate from said reservoir;

(g) means for transferring active electroless plating solution from said flux zone to said plating zone for plating of metal onto the plating surface which is placed within said plating zone; and (h) means for transferring active electroless plating solution from said plating zone to said reservoir.

2. An electroless plating apparatus according to claim 1 further including means for agitating the plating surface when said plating surface is positioned within said plating zone.

3. An electroless plating apparatus according to claim 1 further including first mixer means for mixing said stabilized plating solution in said reservoir and second mixer means for mixing said active plating solution in said plating zone.

4. An electroless plating apparatus according to claim 1 wherein said means for transferring active electroless plating solution from said flux zone to said plating vessel includes a first outlet defining an opening in the flux container said wall and located at a level vertically above said plating vessel to form a first weir over which active electroless plating solution flows out of said flux container; and means associated with said first weir for transferring active electroless plating solution from said first weir to said plating zone.

5. An electroless plating apparatus according to claim 4 wherein said means for transferring active electroless plating solution from said plating zone to said reservoir includes a second outlet defining an opening in the plating vessel side to form a second weir over which active electroless plating solution may flow out of said plating vessel, said second weir being located at a level vertically below said first weir and spaced vertically above the outer container bottom; and means associated with said second weir for transferring active electroless plating solution from said second weir to said reservoir.

6. An electroless plating apparatus according to claim 5 further including a downflow weir located inside said plating vessel and located adjacent to said second weir and extending above and below said second weir to prevent the communication of gases between said plating zone and said reservoir through said second outlet.

7. An electroless plating apparatus according to claim 4 wherein said plating vessel is a microwave waveguide having interior wall surfaces, said interior wall surfaces defining said plating zone.

8. An electroless plating apparatus according to claim 1 further including means for controlling the temperature of said reservoir, flux zone and plating zone at a temperature of between about 20° C. and 80° C.

9. An electroless plating apparatus according to claim 1 wherein said means for transferring stabilized plating solution from said reservoir to said flux zone includes filter means for filtering out particulate matter from said stabilized plating solution.

10. An electroless plating apparatus according to claim 1 wherein said plating vessel is a microwave waveguide having interior wall surfaces, said interior wall surfaces defining said plating zone.

11. An apparatus adapted for use in electroless plating wherein a metal is autocatalytically plated from an electroless plating solution onto a plating surface comprising:

(a) an outer container having a top, a bottom, and side walls defining an oxygen-rich solution reservoir;

(b) oxygen sparger means for introducing an oxygen-containing gas into said oxygen-rich solution reservoir in a sufficient amount to provide predetermined level of oxygen in the electroless plating solution in said oxygen-rich solution reservoir, to produce a stabilized plating solution;

(c) a flux container located inside said outer container, said flux container having a top, a bottom, and side walls defining a flux zone which is separate from said oxygen-rich solution reservoir;

(d) means for transferring stabilized plating solution from said oxygen-rich solution reservoir to said flux zone;

(e) nitrogen sparger means associated with said flux zone for introducing a nitrogen-containing gas into said flux zone to reduce the amount of oxygen in said stabilized plating solution to a level sufficient to produce active electroless plating solution;

(f) a plating vessel located inside said outer container, said plating vessel having a top, a bottom, and side walls defining a plating zone which is separate from said oxygen-rich solution reservoir;

(g) means for transferring active electroless plating solution from said flux zone to said plating zone for plating of metal onto the plating surface which is placed within said plating zone; and (h) means for transferring active electroless plating solution from said plating zone to said oxygen-rich solution reservoir.

* * * * *